US006523710B1

(12) United States Patent
Hidding et al.

(10) Patent No.: US 6,523,710 B1
(45) **Date of Patent: *Feb. 25, 2003**

(54) TAMPER RESISTANT BOTTLE CAP AND NECK

(76) Inventors: Walter E. Hidding, Rte. 7-367A Woodrock Rd., Barrington Hills, IL (US) 60010; Douglas J. Hidding, 412 Caesar Dr., Barrington Hills, IL (US) 60010; Robert D. Hidding, 38W191, Binnie Lake Trail, West Dundee, IL (US) 60118

( * ) Notice: Subject to any disclaimer, the term of this patent is extended or adjusted under 35 U.S.C. 154(b) by 0 days.

This patent is subject to a terminal disclaimer.

(21) Appl. No.: 09/467,433

(22) Filed: Dec. 20, 1999

Related U.S. Application Data

(63) Continuation-in-part of application No. 09/018,620, filed on Feb. 4, 1998, now Pat. No. 6,003,701.

(51) Int. Cl.[7] ..... B65D 41/34
(52) U.S. Cl. ..... 215/252; 215/256
(58) Field of Search ..... 215/252, 256, 215/254, 44, 45, 901, 258, 330

(56) References Cited

U.S. PATENT DOCUMENTS 4,032,029 A * 6/1977 Cochrane ..... 215/256
4,815,620 A * 3/1989 Bullock, III ..... 215/256
4,922,684 A * 5/1990 Nelson
4,930,647 A * 6/1990 Dutt et al. ..... 215/252
4,934,546 A * 6/1990 Markley ..... 215/256
5,092,478 A * 3/1992 La Pierre ..... 215/256
5,213,224 A * 5/1993 Luch ..... 215/256
5,593,055 A * 1/1997 Repp et al. ..... 215/256
5,642,825 A * 7/1997 Wohlgemuth ..... 215/256
5,975,321 A * 11/1999 Luch ..... 215/256
6,003,701 A * 12/1999 Hidding et al. ..... 215/252

* cited by examiner

*Primary Examiner*—Nathan J. Newhouse
(74) *Attorney, Agent, or Firm*—Baker & McKenzie

(57) ABSTRACT

An improved tamper resistant bottle cap and neck for bottles which hold liquid. The bottle cap of the present invention includes a circular cover, a skirt depending from the periphery of the cover, and a tamper evidencing lower portion. A raised ring formed on the outer and upper surface of the bumper roll typically used in blow-molded containers protects the lower edge of the cap from tampering by making the lower edge of the ratchet ring in the case of a thread-on cap (or the lower edge of the removable portion of a skirt in the case of a push-on cap) less accessible to potential tamperers. Thread-on caps with helical threads and a ratchet ring, or push-on caps with skirts having removable lower portions, may each be equipped with an arched or curved pull tab. The pull tab in each instance is designed to accommodate a raised ring on the bumper roll of the neck of a blow-molded bottle. By designing the pull tab to accommodate the raised ring on the bumper roll the presence of the ring does not induce unwanted stresses and deformations into the pull tab or the skirt or ratchet ring to which the pull tab is connected.

11 Claims, 9 Drawing Sheets

TAMPER RESISTANT BOTTLE CAP AND NECK

This is a continuation-in-part application of parent application Ser. No. 09/018,620 filed Feb. 4, 1998, now U.S. Patent 6,003.701.

BACKGROUND AND SUMMARY OF THE INVENTION

1. Field of the Invention

This invention relates to closure devices, and in particular, relates to an injection molded tamper resistant bottle cap and neck for blow-molded bottles of the kind which are commonly used to hold and transport liquids, such as milk and juice.

2. Description of the Related Art

Injection molded caps for blow molded bottles have been used for many years. Generally, two types of bottle caps are available, push-on caps and thread-on caps. Push-on caps are installed by aligning the cap with the opening of a bottle and simply applying an axial force to the top of the cap. Thread-on caps generally require that the cap and bottle be aligned and that a rotative force be applied to the cap. In some cases, threaded caps, if carefully designed in conjunction with the bottle to which it is applied, can be made so that the rotative force required to install the cap is minimized or even eliminated. These kinds of injection molded caps are often made with low density polypropylene, a common material used in injection molding.

One of the problems associated with injection molded caps relates to the tamper-evident connection which must be created between the bottle cap and bottle. One method of forming a tamper-evident connection is to use a threaded bottle cap which includes a ratchet ring having internal ratchet teeth in combination with a bottle neck having external ratchet teeth. When the bottle cap is screwed on the bottle neck, the ratchet teeth of the bottle cap ride over the mating ratchet teeth on the bottle neck, thereby enabling the bottle cap to be fully tightened on the bottle neck. However, when a user attempts to unscrew the bottle cap using low-to-medium twisting force, the ratchet teeth of the bottle cap positively engage the mating ratchet teeth of the bottle neck, thereby preventing unthreading and unsealing of the cap. When higher levels of twisting force are applied to the bottle cap in the direction of unscrewing, the ratchet ring breaks away from the bottle cap and the bottle cap may be unscrewed from the bottle neck. In this manner, removal of the ratchet ring from the bottle cap serves as visual evidence that the bottle has been opened.

While the combination of a bottle cap with a tamper evidencing ring and a bottle neck with ratchet teeth provides for an acceptable tamper-evident connection, this combination does have its limitations. Specifically, it may be possible for a person to pull the lower edge of the ratchet ring outward and then upward toward the cover of the bottle cap in order to defeat the locking action of the ratchet teeth of the bottle cap and bottle neck. It would then be possible to unscrew the bottle cap without breaking the ratchet ring away from the bottle cap and to screw the bottle cap back on the bottle neck. If this were to occur, there may be little visual evidence that the cap has been unscrewed and subsequently screwed back on the bottle neck. Therefore, present tamper-evident connections between a bottle cap and bottle neck may not provide optimum tamper resistance in certain circumstances.

For the foregoing reasons, there is a need for an improved tamper resistant bottle cap and bottle neck which further limit the ability of a person to tamper with the contents of a bottle. Specifically, there is a need for a tamper resistant bottle cap and bottle neck which limit the ability of a person to pry a tamper evidencing ring with ratchet teeth away from the mating ratchet teeth on a bottle neck, unscrew the cap from the bottle neck, and subsequently screw the cap back on the bottle neck.

It is therefore a primary object of the present invention to provide an improved tamper resistant bottle cap and bottle neck for use in bottles which hold liquids, such as milk and juice.

It is a further object of the present invention to provide an improved tamper resistant seal between a bottle cap and a bottle neck.

It is another object of the present invention to provide a tamper-evident threaded bottle cap with an improved ratchet ring which limits the ability of a person to pull the lower edge of the ratchet ring outward and then upward toward the cover of the bottle cap in an effort to defeat the locking action of the ratchet teeth of the bottle cap and the ratchet teeth of the bottle neck.

It is yet another object of the present invention to provide a bottle neck with an improved circumferential ring which makes it is very difficult to insert an object under the outer lower corner of a ratchet ring of a bottle cap and pry the ratchet ring of the bottle cap away from the bottle neck in an effort to defeat the locking action of the ratchet teeth of the bottle cap and the ratchet teeth of the bottle neck.

SUMMARY OF THE INVENTION

The present invention is directed to a tamper resistant bottle cap and bottle neck that satisfy the need for a bottle closure with an improved tamper resistant seal. A bottle closure having the features of the present invention broadly comprises a bottle cap and a bottle neck.

The bottle cap of the present invention includes a circular cover, a skirt depending from the periphery of the cover, and a tamper evidencing ring. The skirt of the bottle cap includes an interior surface having threads for retaining the cap to a bottle neck and a lower end having a circumferential flange with semi-circular outwardly extending tabs. The tamper evidencing ring of the bottle cap includes a plurality of ratchet teeth which are capable of meshing with a matching set of ratchet teeth on a bottle neck. The tamper evidencing ring is connected to the flange by frangible connections between the outwardly extending tabs of the flange and the ratchet teeth of the tamper evidencing ring. Each of the frangible connections is generally defined by an area of overlap between a lower surface of each tab and an upper surface of each of the ratchet teeth of the tamper evidencing ring.

The use of tabs connected to ratchet teeth as a means for attaching the tamper evidencing ring to the skirt of the cap provides for a bottle cap that limits the ability of a person to pull the lower edge of the ratchet ring outward and upward toward the cover of the cap as the strong connections between the tabs and ratchet teeth resist twisting. Therefore, the design of the bottle cap of the present invention, wherein the attachment of the skirt and the tamper evidencing ring of the bottle cap is made by way of a connection between tabs and the ratchet teeth of the tamper evidencing ring, provides for a bottle cap having increased tamper resistance.

The bottle neck of the present invention includes an opening at its upper end, a cylindrical exterior surface having threads for retaining a bottle cap, a circumferential ratchet portion below the threads, and a circumferential transfer ring below the ratchet portion. The ratchet portion includes ratchet teeth which are capable of meshing with a matching set of ratchet teeth on a bottle cap. The circumferential transfer ring includes an annular top surface and an upwardly extending circumferential ridge on the periphery of the annular top surface.

The threads of the bottle cap and the bottle neck of the present invention are appropriately dimensioned so as to sealingly engage when the bottle cap is screwed onto the bottle neck. After the bottle cap has been screwed onto the bottle neck, a lower edge of the tamper evidencing ring is located adjacent the top surface of the transfer ring and the ratchet teeth of the bottle neck and the ratchet teeth of the bottle cap are engaged so as to prevent unscrewing of the bottle cap relative to the bottle neck without breaking the frangible connections. The location of the lower edge of the tamper evidencing ring adjacent the top surface of the transfer ring provides additional tamper resistance to the combination of the bottle cap and bottle neck of the present invention. Specifically, when the bottle cap is fully threaded onto bottle neck, the ridge of the transfer ring completely surrounds the lower portion of the ratchet ring so that it is very difficult to insert a thin object, such as a fingernail, under the outer lower corner of the ratchet ring. Therefore, it is difficult to insert an object under the ratchet ring and pry the ratchet ring away from the bottle neck in an effort to defeat the locking action of the ratchet teeth of the ratchet ring and the ratchet teeth of the bottle neck.

BRIEF DESCRIPTION OF THE DRAWINGS

These and other features, aspects, objects, and advantages of the present invention will be become better understood upon consideration of the following detailed description, appended claims and accompanying drawings where:

Figure 1:
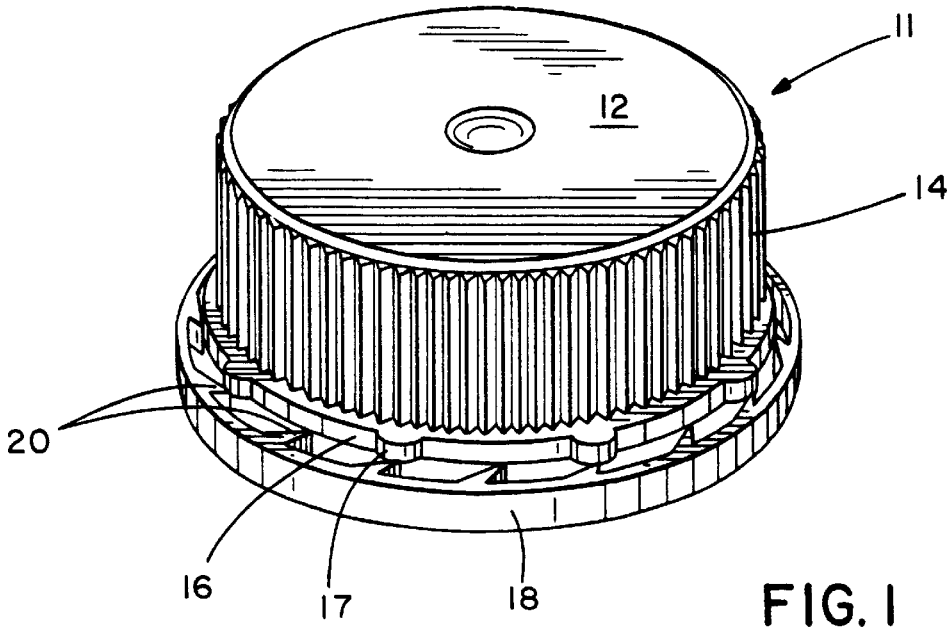
FIG. 1 is a perspective view of a bottle cap made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

Like reference numerals will be used to refer to like or similar parts from Figure to Figure in the following description of the drawings.

DESCRIPTION OF THE PREFERRED EMBODIMENTS

Figure 2:
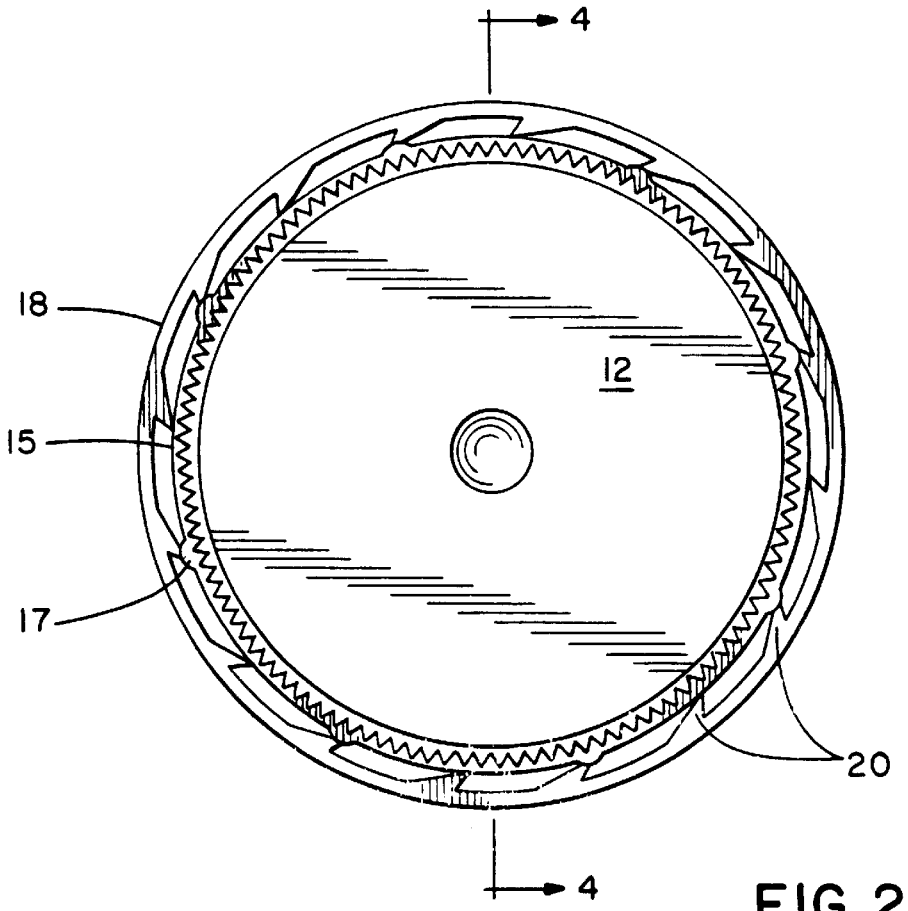
FIG. 2 is a top view of a bottle cap made in accordance with the present invention.

FIGS. 1 and 2 generally depict the outside of a bottle cap 11. The cap 11 is comprised of a circular cover 12 and a depending skirt 14 with knurls 15 formed on the outside surface thereof. A flange 16 is formed at the bottom of the skirt. The flange 16 includes a plurality of semi-circular outwardly directed tabs 17 which are equally spaced around the flange 16. A ratchet ring 18 including a plurality of ratchet teeth 20 is frangibly connected to the tabs 17 of the flange 16 by way of connections between each tab 17 and every other tooth 20 around the circumference of the flange 16. The ratchet ring 18 has a lower edge 21 and an outer edge 22 which meet in an outer lower corner 23 of the ratchet ring 18, as can be seen in FIG. 4.

Figure 3:
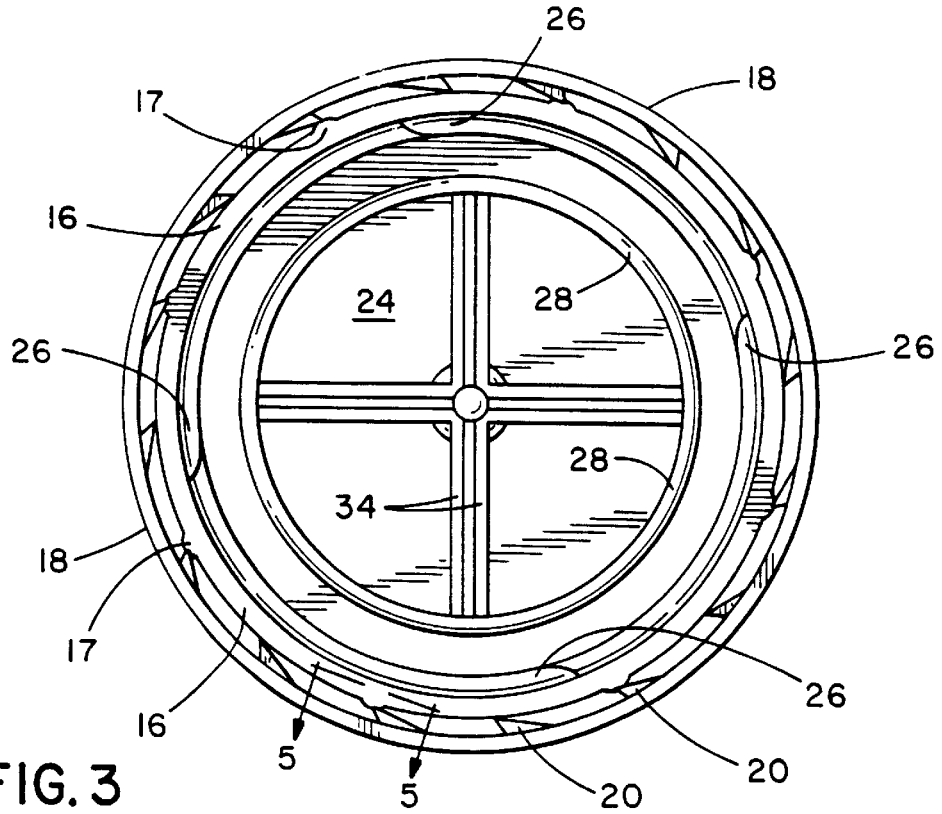
FIG. 3 is a bottom view of a bottle cap made in accordance with the present invention.

FIG. 3 shows the underside 24 of the cover 12. Four distinct threads 26 are formed on the inside surface of the skirt 14. A sealing plug 28 is also formed on the underside 24 of the cover 12.

Bottle caps generally, and threaded caps in particular, tend to shrink most where there is substantial differential in volume of plastic material. Bottle caps which are injection molded tend to shrink in such a way as to deform an initially flat cover 12 into a dome-shaped surface. Significant volume of material is required to form threads which are sufficiently strong to hold the cap 11 in place. The cover 12, on the other hand, needs only to have sufficient thickness to withstand puncturing forces. The shrinkage of the cap 11 to form a dome ("doming") creates problems as it relates to dimensional stability and sealing effectiveness, and sometimes causes problems relating to the affixing of a label on the top of the cover 12. For example, radially inward shrinkage will tend to reduce the outside diameter of the plug 28. To reduce the effects of such shrinkage, the cap 11 has means for limiting the doming of the cover 12. Four pairs of radial ribs 34 extend from the center of the underside 24 of the cover 12 to the plug 28. The radial ribs 34 provide the cover 12 with structural integrity sufficient to withstand the tendency for the cover 12 to assume a domed shape. In addition, by providing the cover 12 with additional volume of plastic material, the differential in material volume between the cover and the skirt is reduced, which tends to further reduce the distorting effects of shrinkage.

Figure 4:
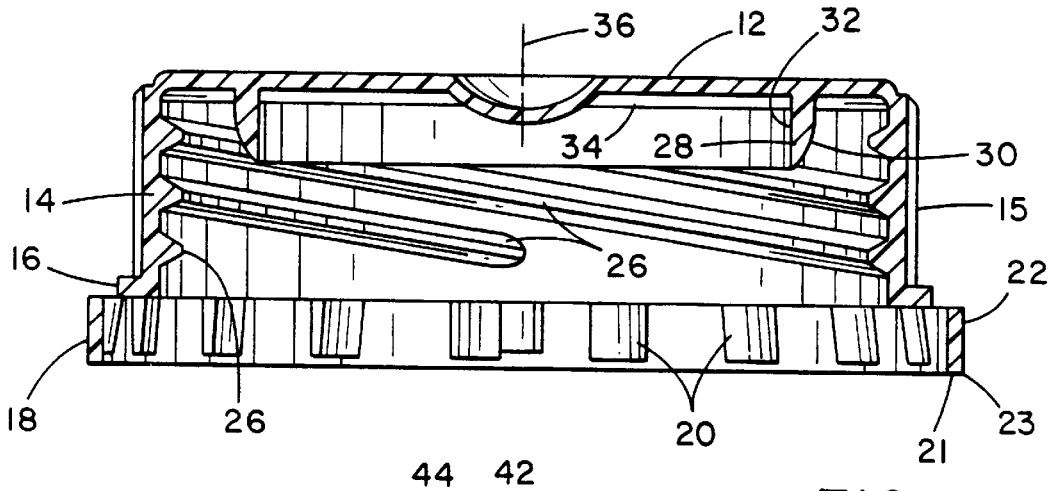
FIG. 4 is a cross-sectional view taken along line 4—4 of FIG. 2.

FIG. 4 more clearly shows the location and configuration of the plug 28. The plug 28 is a generally circumferentially continuous formation integrally connected to the underside 24 of the cover 12. The plug 28 is disposed about the central axis 36 of the cap 11. The plug 28 has an outer surface 30 which is generally parabolic about the axis 36 and an inner surface 32 substantially parallel to the axis 36. It is important in order to achieve proper sealing that the surfaces which comprise the plug 28 be concentric about the central axis of the cap 11.

In an alternative embodiment of the present invention, the underside 24 of cover 12 does not include the plug 28 and the four pairs of radial ribs 34. The absence of a plug and radial ribs means that the cap could be used with a foil liner having a heat sensitive surface which can be heated into sealing engagement with the upper surface of a bottle neck by induction heating.

Figure 5:
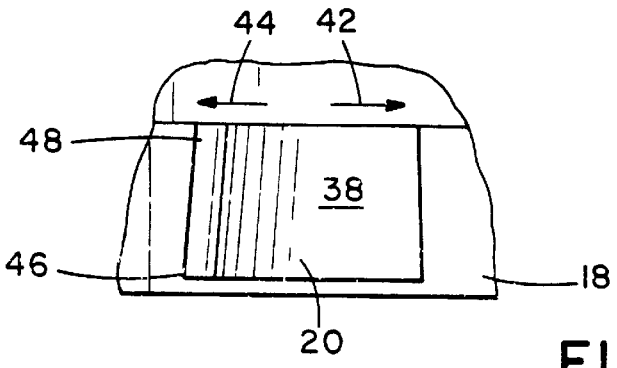
FIG. 5 is an enlarged view taken along line 5—5 of FIG. 3.
Figure 6A:
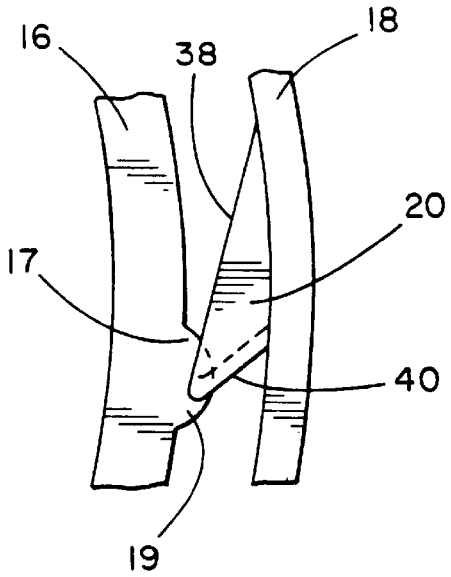
FIG. 6A is an enlarged bottom view of the tooth shown in FIG. 5.
Figure 6B:
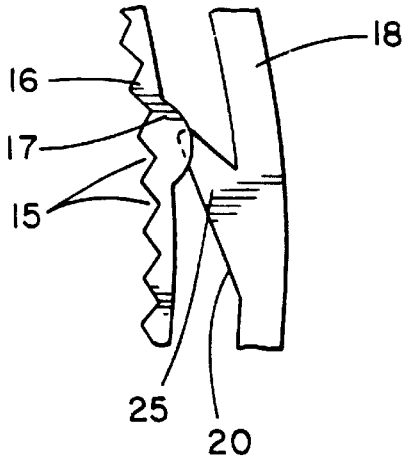
FIG. 6B is an enlarged top view of the tooth shown in FIG. 5.

FIGS. 5, 6*a* and 6*b* more clearly show the configuration of the ratchet teeth 20 and the semi-circular outwardly directed tabs 17 of the flange 16. Each tooth 20 is comprised of a ramp surface 38 and an abutting surface 40. Arrow 42 indicates the direction in which the cap 11 moves when the cap 11 is installed or tightened. Arrow 44 indicates the direction required to unscrew the cap 11. The abutting surface 40 of the tooth 20 is sloped in such a way that the lower edge 46 of the tooth 20 is offset with respect to the upper portion 48 of the tooth 20 in the direction (Arrow 44) of unscrewing the cap 11. As a result, as the tooth 20 engages a mating ratchet tooth on a bottle neck, the lower edge 46 of the tooth 20 will engage the mating ratchet tooth first. The sloping nature of the abutting surface 40 will enhance the engagement of the tooth 20, and will resist unintended camming or slippage of the teeth 20 on the cap 11 relative to the matching ratchet teeth on the bottle neck. Thus, when cap 11 is turned in direction 42, the ratchet teeth 20 of the cap will ride over the mating ratchet teeth on the bottle neck, and when the cap is turned in direction 44, the ratchet teeth 20 of the cap 11 will positively engage the mating ratchet teeth of the bottle neck.

FIG. 6A, which is a bottom view of the tooth 20 shown in FIG. 5, and FIG. 6B, which is a top view of the tooth 20 shown in FIG. 5, also show the attachment of the ratchet teeth 20 to the semi-circular outwardly directed tabs 17 of the flange 16. Each of the ratchet teeth 20 includes an upper surface 25 which is generally coplanar with the cover 12 of the cap 11. Each of the semi-circular outwardly directed tabs 17 of the flange 16 includes a lower surface 19 which is also generally coplanar with the cover 12 of the cap 11. The lower surface 19 of each tab 17 has an area substantially in the shape of a semicircle.

Tabs 17 are shown as having the same vertical extent as the flange 16. However, the tabs may have a height which is less than the height of the flange 16.

The tabs 17 and the ratchet teeth 20 are attached by way of a frangible connection between the lower surface 19 of each tab 17 and the upper surface 25 of each of the ratchet teeth 20. It can be seen from FIGS. 6A and 6B that the cross-sectional area of the frangible connection between a tab 17 and one of the ratchet teeth 20 is defined by the area wherein the lower surface 19 of each tab 17 and the upper surface 25 of each of the ratchet teeth 20 overlap. It can be appreciated that by varying the area of overlap between the lower surface 19 of each tab 17 and the upper surface 25 of each of the ratchet teeth 20, the strength of the frangible connection between the tabs 17 and the ratchet teeth 20 can be adjusted, as a frangible connection having a greater cross-sectional area will require a greater force in order to fracture the connection.

The adjustment of the area of overlap between the lower surface 19 of the tabs 17 and the upper surface 25 of the ratchet teeth 20 can be made using an injection molding die having portions which are movable with respect to each other. Namely, an injection molding die can be constructed wherein a first element of the die which molds the tabs 17 and a second element of the die which molds the ratchet teeth 20 are rotatable in relation to each other. When a bottle cap having stronger connections between the tabs 17 and the teeth 20 of the ratchet ring 18 is desired, the first and second element of the die are rotated so that the area of overlap between the lower surface 19 of each of the tabs 17 and the upper surface 25 of each of the ratchet teeth 20 is increased. In a similar manner, the strength of the connection between the tabs 17 and the teeth 20 of the ratchet ring 18 can be decreased by decreasing the area of overlap between the lower surface 19 of each of the tabs 17 and the upper surface 25 of each of the ratchet teeth 20. Therefore, the use of tabs 17 connected to ratchet teeth 20 as a means for attaching the ratchet ring 18 to the skirt 14 of the cap 11 provides for a bottle cap design wherein the torque required to fracture the frangible connection between the skirt 14 and ratchet ring 18 can be precisely controlled. In addition, the means for attaching the ratchet ring 18 to the skirt 14 provides for a bottle cap design that limits the ability of a person to pull the lower edge 21 of the ratchet ring 18 outward and then upward toward the cover 12 of the cap 11 as the strong connections between the tabs 17 and ratchet teeth 20 resist twisting of the ratchet ring outward and upward.

The need to adjust the strength of the connection between the ratchet ring and the skirt may arise from a change in the material used to form the cap. Low density polypropylene caps, for example, will require more of an overlap (i.e., more cross-section area connecting) between the ratchet tooth and the bottom surface of the flange 16, than will caps made of high density polypropylene. Thus, if a customer's application calls for a cap made of a material different from the material used to make a previous cap, the same tooling may be used and the change of materials may be accounted for by a simple relative rotation of the molds. Moving the mold for the ratchet ring relative to the molding for the body of the cap will cause an inward (or decrease) in the cross-sectional area of connecting material between the teeth and the tabs extending from the flange. Specifically, for example, moving the molds in a way which causes the ring 18 (in FIG. 6A) to be formed in a position upwardly (as shown in FIG. 6A) will reduce the area of connection.

In contrast, the attachment of the ratchet ring to the skirt in prior bottle cap designs is often accomplished by way of a number of thin stretchable strips of material which are connected to a bottom edge of the skirt and to an inner side surface of the ratchet teeth or an inner side surface of the ratchet ring. The ability to vary the strength of the thin connecting strips in these designs is quite limited as the area of overlap between the connecting strip and the skirt or ratchet ring cannot be easily varied. Furthermore, the thin strips of material connecting the skirt and ratchet ring are often weak and cannot resist twisting of the lower edge of the ratchet ring outward and then upward toward the cover of the cap.

Figure 7:
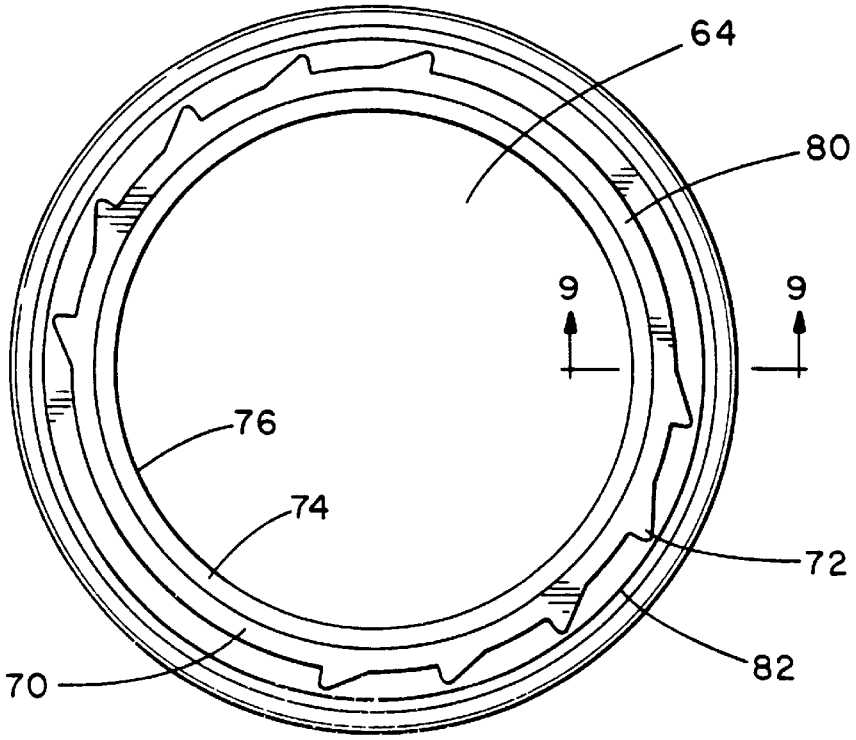
FIG. 7 is a top view of a bottle neck made in accordance with the present invention.
Figure 8:
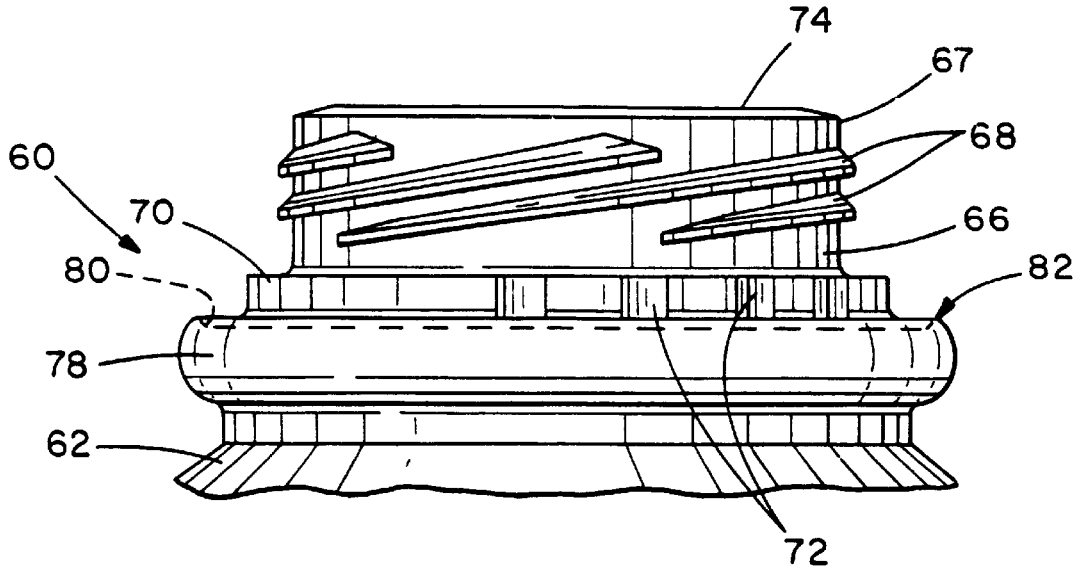
FIG. 8 is a side view of a bottle neck made in accordance with the present invention.
Figure 9:
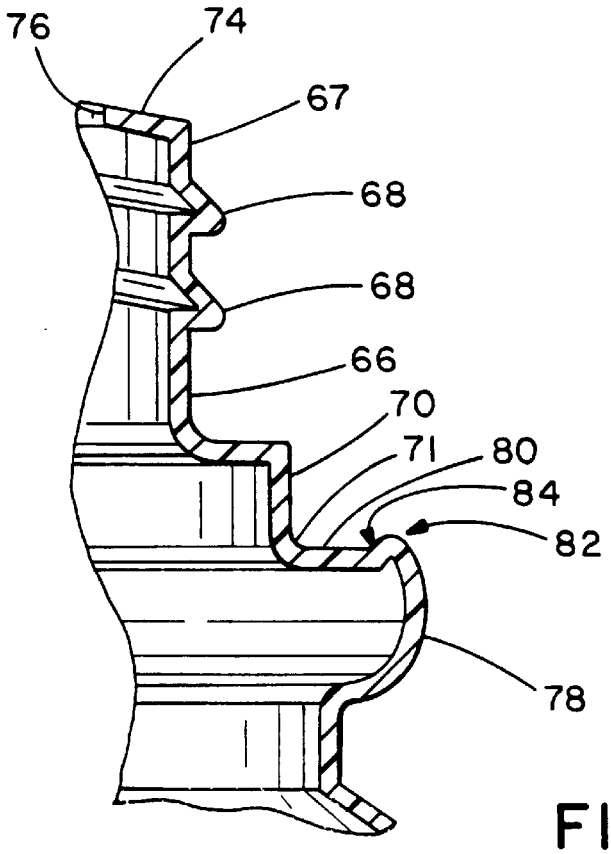
FIG. 9 is a cross-sectional view taken along line 9—9 of FIG. 7.

Referring now to FIGS. 7, 8 and 9 there is shown a bottle, indicated generally at 60, upon which the bottle cap 11 of the present invention may be installed. The bottle 60 includes a body 62 and a cylindrical bottle neck 66 which is integral with the body 62. The bottle neck 66 has an upper opening 64 and an upper end 67 which terminates in an inwardly directed circumferential sealing lip 74 with an inner edge 76. The bottle neck 66 also includes four external screw threads 68 which engage threads 26 of bottle cap 11.

The bottle neck 66 further includes a circumferential ratchet portion 70 having ratchet teeth 72. The ratchet teeth 72 engage the ratchet teeth 20 of the ratchet ring 18 of the bottle cap 11 when the bottle cap 11 is installed on the bottle neck 66. In the preferred embodiment shown in FIG. 7, the ratchet teeth 72 are not arranged around the entire circumference of the ratchet portion 70, but are arranged in two groups, each of the two groups occupying an arc covering about one quarter of the circumference of the ratchet portion 70. It can be seen that the groups of ratchet teeth 72 are arranged on diametrically opposite sides of the bottle neck 66.

The bottle neck 66 also includes a circumferential "bumper roll" or transfer ring 78 located below the ratchet portion 70. In prior bottle neck designs, a bumper roll has been provided on a bottle neck for manufacturing purposes as it facilitates gripping the bottle during the filling operation and grabbing the bottle during the loading of the bottle into a shipping container. However, the bumper roll 78 of the bottle neck 66 of the present invention includes additional features which provide even further advantages.

It can be seen from FIGS. 7, 8 and 9 that bumper roll 78 includes a substantially flat annular top surface 80 which has an upwardly extending circumferential ridge 82 along the entire length of its periphery. Preferably, the top surface 80 of the bumper roll 78 is substantially parallel with respect to a plane defined by the opening 64 of the bottle neck 66. Also, it is preferred that the top surface 80 of the bumper roll 78 is joined to a lower end 71 of the ratchet portion 70 and that the uppermost point of the ridge 82 of the bumper roll 78 is above the lower end 71 of the ratchet portion 70. The placement of a ridge 82 on the periphery of the top surface 80 of the bumper roll 78 serves to increase the resistance of the bottle neck 66 and bottle cap 11 to unwanted removal of the cap by an individual seeking to tamper with the contents of the bottle. Specifically, when bottle cap 11 is fully threaded onto bottle neck 66, the lower edge 21 of ratchet ring 18 is placed in contact with or closely adjacent to the top surface 80 of bumper roll 78, and the outer edge 22 of the ratchet ring 18 is placed adjacent to the inner surface 84 of ridge 82. In this arrangement of the ratchet ring 18 of the bottle cap 11 and the bumper roll 78 of bottle neck 66, the ridge 82 of the bumper roll 78 completely surrounds the lower portion of the ratchet ring 18 so that it is very difficult to insert a thin object, such as a fingernail, under the outer lower corner 23 of the ratchet ring 18. Therefore, the ridge 82 of the bumper roll 78 improves the tamper resistance of the bottle as it is extremely difficult to insert an object under the ratchet ring 18 and pry the ratchet ring 18 away from the bottle neck 66 in an effort to defeat the locking action of the ratchet teeth 20 of the ratchet ring 18 and the ratchet teeth 72 of the bottle neck 66.

Thus, it is seen that an improved tamper resistant bottle cap and neck are provided which satisfy the need for a bottle with an improved tamper resistant seal. The present invention includes a bottle cap with an improved means for connecting a tamper evidencing ring to the cap which limits the ability of a person to defeat the locking action of ratchet teeth on the tamper evidencing ring and bottle neck. The present invention also includes a bottle neck with an improved transfer ring which makes it difficult to insert an object under the ratchet ring and pry the ratchet ring away from the bottle neck.

Figure 10:
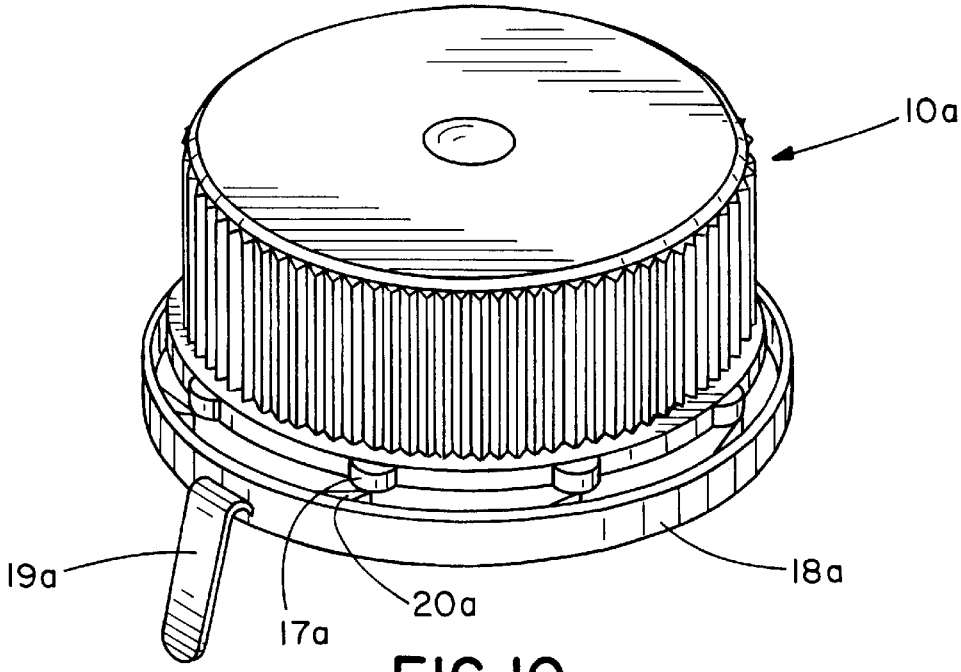
FIGS. 10 and 11 are perspective views of a helically threaded cap of the present invention, from above and below respectively, showing a pull tab adapted to accommodate the neck of the present invention.

FIG. 10 shows a cap 10*a* with a pull tab 19*a* extending outwardly from outer surface 22*a* of the ratchet ring 18*a*. The cap 10*a* of FIG. 10 has ratchet teeth 20*a*, each of which is connected to a tab 17*a*, as opposed to every other ratchet tooth being connected as shown earlier.

Figure 11:
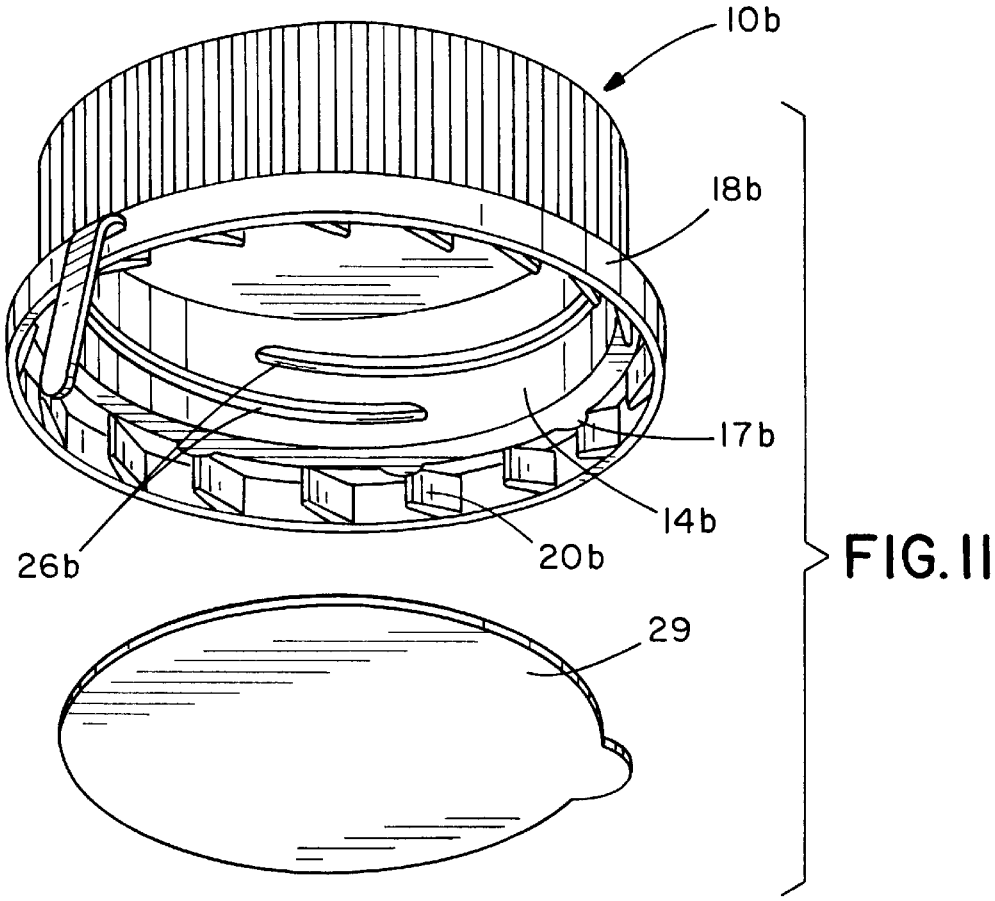

FIG. 11 shows an assembly of a cap 10*b* and a liner 29 which is made of a foil and paper laminate capable of being connected by an induction heating process to the upper lip of a container neck. The cap 10*b* of FIG. 11 has every other one of the ratchet teeth 20*b* connected via a tab 17*b* to the skirt 14*b* of the cap 10*b*. A pull tab 19*b* extends from the ratchet ring 18*b*.

Figure 12:
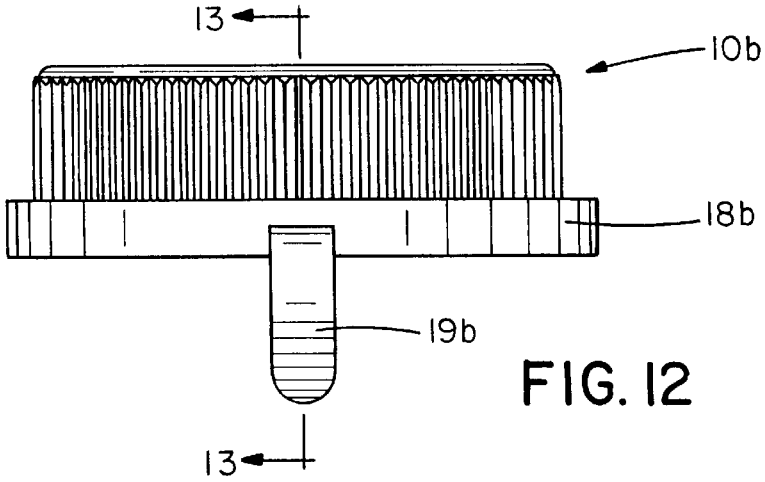
FIGS. 12, 13 and 14 are side views of the cap shown in FIGS. 10 and 11, with FIGS. 13 and 14 being sectional views, and FIG. 14 showing the cap as it sits on a bottle neck.
Figure 13:
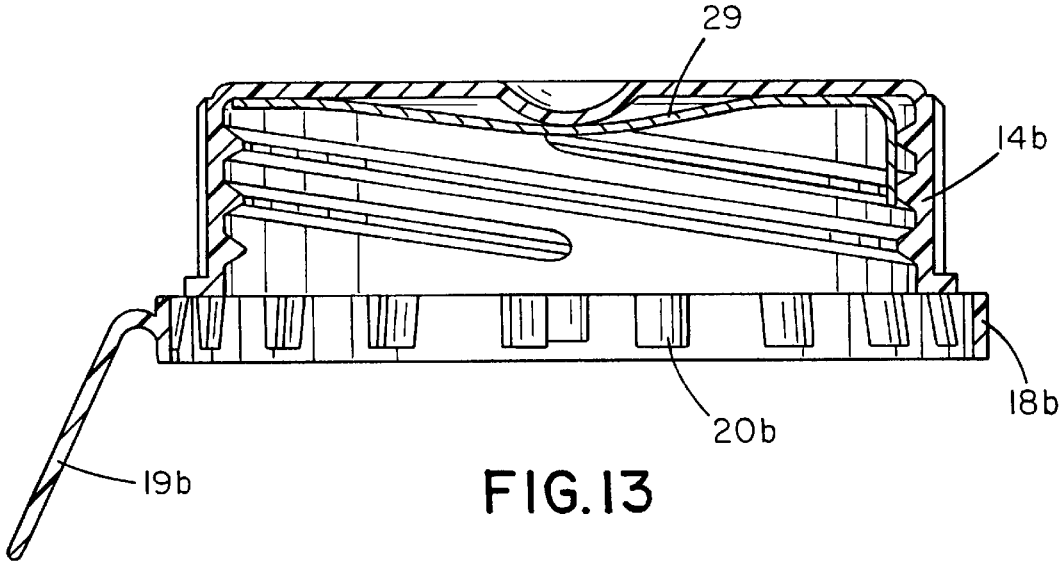

FIGS. 12 and 13 are side and cross-sectional views of the cap 10*b* shown in FIG. 11. In FIGS. 12 and 13, the lines 29 shown as having been assembled by insertion past the threads 26*b* to a position adjacent to the underside 24*b* of the cover 12*b*.

Figure 14:
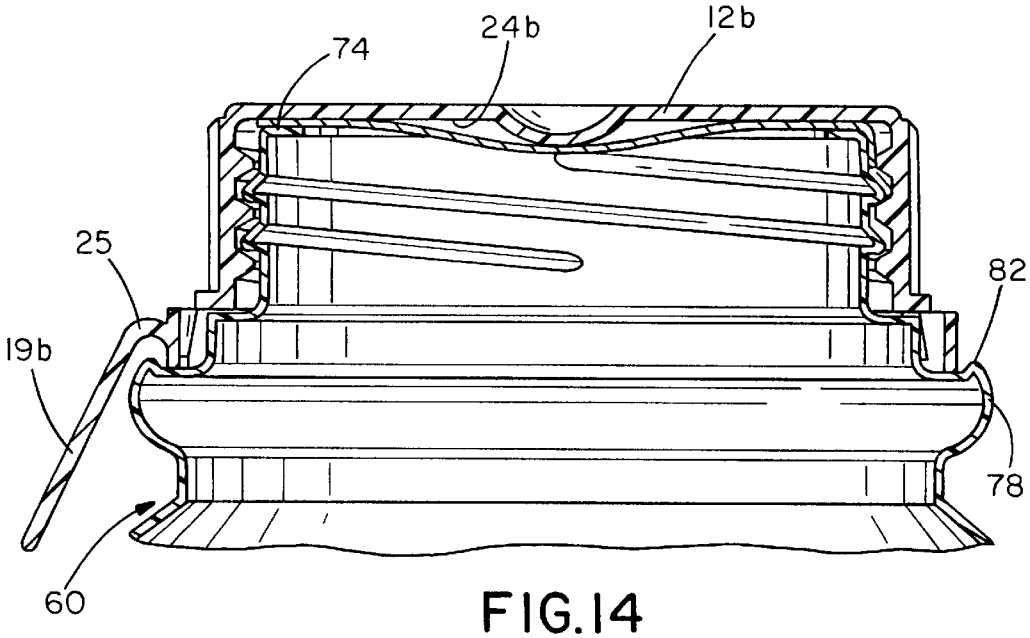

FIG. 14 shows the cap 10*b* with lines 29 having been carried thereby into an assembled position in which the liner is affixed by induction heating to the top surface of a sealing lip 74 on a container neck 66. The fit between the cap 10*b* and the container neck 66 is such that threading of the cap 10*b* onto the neck 66 and the external threads 68 causes the lip 74 to be deflected in a resilient manner to a generally horizontal position so that an outer area of the lines 29 can come into firm contact with the top surface of the lip 74. This provides an area of contact by which a bond may be formed between a plastic layer. Film carried by the foil liner can fuse to the lip 74 upon being heated by induction heating after the cap 10*b* is threaded onto the neck 66.

The shape of the pull tabs 19*a* and 19*b*, as shown in FIGS. 10 through 14, is like an inverted letter "J". A curved upper part 25 accommodates the ridge 82 formed on the bumper roll 78 to prevent stress and deformation in the ratchet ring 18*b*. The curved part 25 of the pull tab 19*b* extends initially upwardly from the outside of the ratchet ring 18*b*, then outwardly and finally downward and outward on an angle away from the bumper roll 78.

Figure 13A:
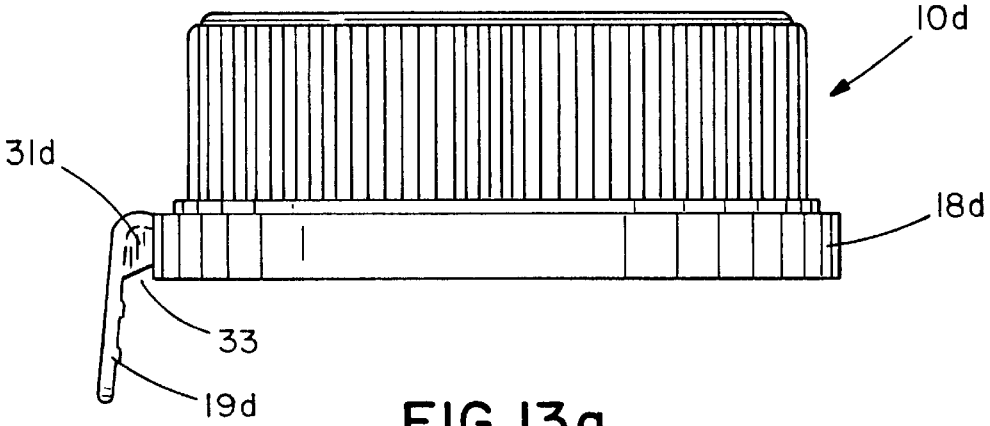
FIGS. 13*a* and 14*a* are sectional views of an alternative embodiment of a helically threaded cap, similar to the cap of FIGS. 13 and 14, wherein, however, the pull tab is configured so as to avoid difficulties related to automatic feeding of caps of the present invention.
Figure 14A:
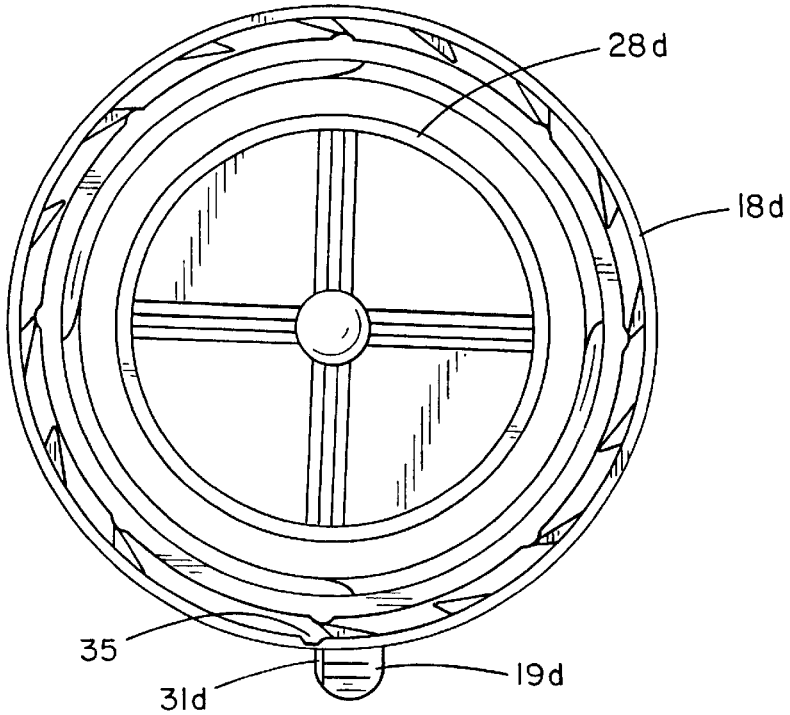
Figure 15:
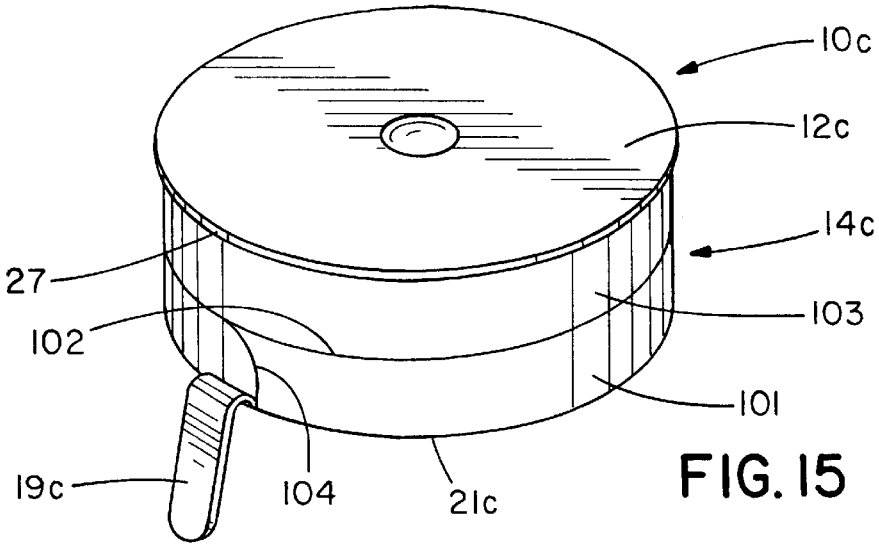
FIGS. 15, 16 and 17 are perspective, side elevational and bottom plan views of a push-on cap of the present invention in which the cap has a pull tab configured to accommodate a neck finish of the present invention.
Figure 16:
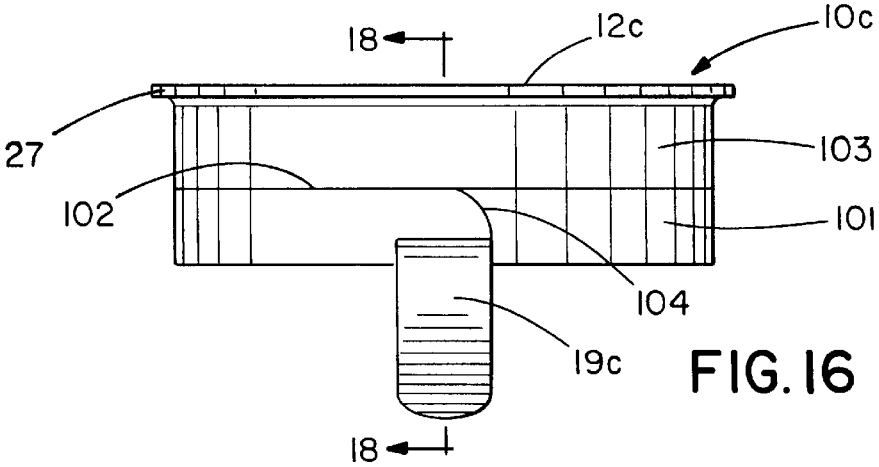

FIGS. 13*a* and 14*a*, show a cap 10*d* which is helically threaded on the inside and has a plug 28*d*, as opposed to a foil liner for purposes of sealing a container neck. The cap 10*d* has a pull tab 19*d* which is attached to the upper edge of the ratchet ring 18*d*. The pull tab 19*d* also has a connecting web 31*d* which extends about ⅓ of the way down from the curved upper portion of the tab 19*d* to the free lower end of the tab 19*d*. By connecting the tab 19*d* to the upper portion of the ratchet ring 18*d*, there is less likelihood for adjacent caps in an automatic feeding device to become entangled. The web 31*d* extends from the underside of the pull tab 19*d* and it point of connection to the upper portion of the ratchet ring 18*d* down to near the lower edge of the ratchet ring to facilitate twisting removal of the ratchet ring 18*d* by upward lifting of the pull tab 19*d*. The inside of the ratchet ring has a vertically oriented thin section 35 along which the web is aligned on outside surface of the ratchet ring. The point of attachment of the web is located in this manner to further facilitate the breaking and removal of the ratchet ring with the pull tab.

It should be noted that the configuration of the ratchet ring 19*d* may also be advantageously used on push-on caps- as described below to avoid entanglement of push-on caps as they are fed to a capping station in bottling line by an automatic feeding device. By locating the connection point of the pull tab near the top of the removable skirt of such caps there is no crevice for one cap to become "hung-up" on an adjacent cap. In both instances, the web is vertically oriented and extending from an edge or side of the pull tab to a connection location extending vertically from a lower part of the ratchet ring (or removable skirt, in the case of a push-on cap) to the point at which the main portion of the pull tab interfaces horizontally with an upper portion of the ratchet ring. The web should be made with an opening 33 (FIG. 13*b*) to accommodate, i.e. not interfere with, the ridge (82 or 182) which extends upwardly from the bumper roll of the neck finish to which the cap is applied.

An advantage of the present invention arises from the use of a pull tab which extends in the axial direction below the lower edge of the ratchet ring on a threaded cap. The pull tab may be used, as part of the feeding of the cap, to orient the threads of the cap in a particular way. For example in a four-thread cap, one of the four threads may be designed to start (i.e. at its lower end) at a radial location adjacent to the pull tab; similarly, the threads of the neck finish with which such caps will be used may be molded so that the threads of the bottle neck will be well-aligned with the cap when the two components, i.e. the cap and the neck, are brought together in a capping operation. By using the pull tab to control the relative positions of the thread on the cap and the bottle neck, misalignment and cross-threading can be minimized or even eliminated. This advantage, the proper alignment of threads on the cap and neck, can greatly reduce the potential for jamming and line stoppage in a bottling facility.

FIGS. 15 through 19 show a further embodiment of the inventions in that a push-on cap 10*c* is shown with a pull tab 19*c*. A cover 12*c* and a skirt 14*c* meet at an upper zone of the cap 10*c*, and a flange 27 extends laterally outwardly from the cover 12*c*. Gripping bumps 29 are formed on the inside surface of the pull tab 19*c*. The skirt 14*c* includes a lower section 101 and an upper section 103. A circumferential thin-walled connecting section 102 connects the upper section 103 to the lower section 101. A curved extension 104 of the thin-walled connecting section 102 extends from that section down to the lower edge 21*c* of the skirt 14*c*, whereby lifting of the pull tab 19*c* begins a tearing separation of the lower section 101 along section 104 which continues along section 102. The thickness of the skirt at section 104 and 102 is substantially less than the thickness of the skirt at other locations so that the tearing action initiated by lifting the pull tab 19*c* follows the line of weakness defined by section 104 and 102.

Figure 18:
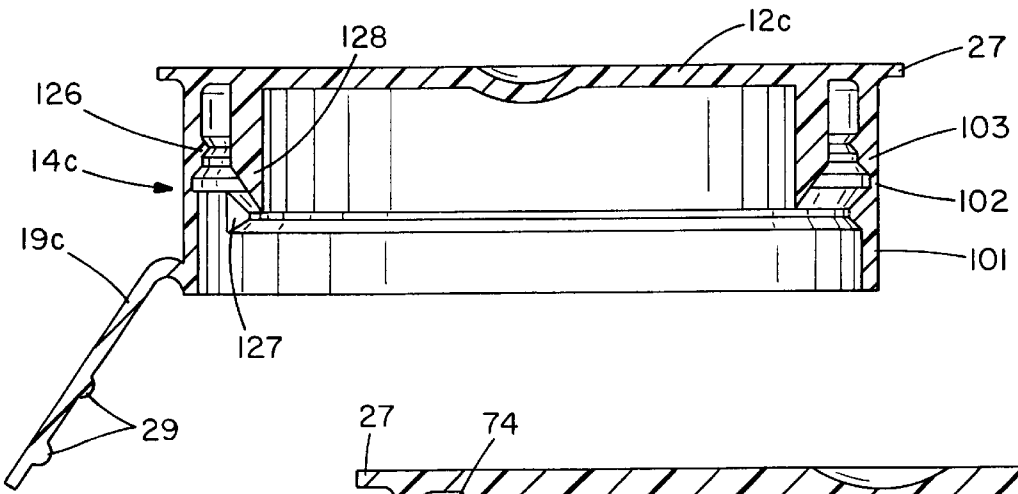
FIGS. 18 and 19 are sectional views of the cap shown in FIGS. 15—17, with FIG. 19 showing the cap in combination with a bottle neck made in accordance with the present invention.

As can be seen in FIG. 18, the lower bead 127 formed on the inside of the lower section 101 is interrupted; this allows for the thin-walled section 104 to converge and continuously connect the lower edge 21*c* of the lower section 101 to the thin-walled section 102 which enables the lower section 101 to be completely and neatly separated from the upper section 103 of the skirt 14*c*.

Figure 17:
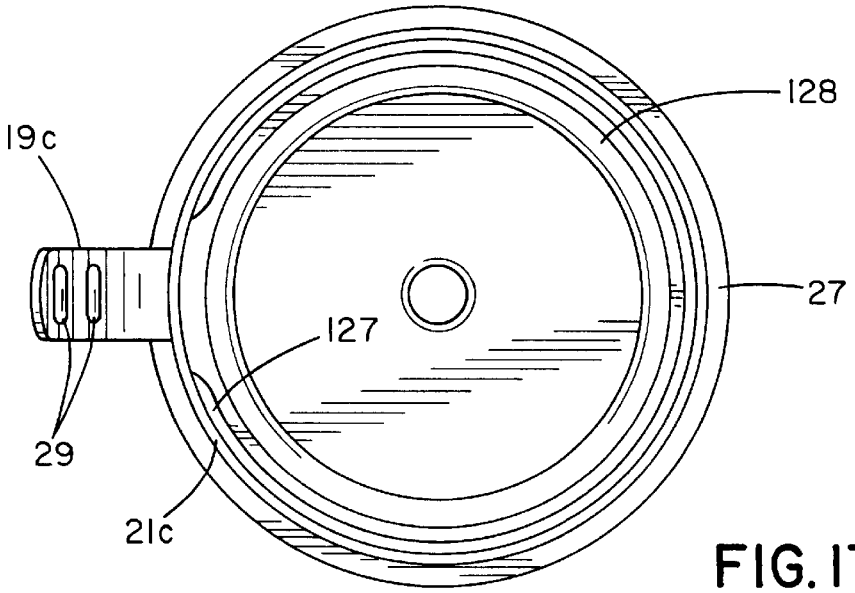
Figure 19:
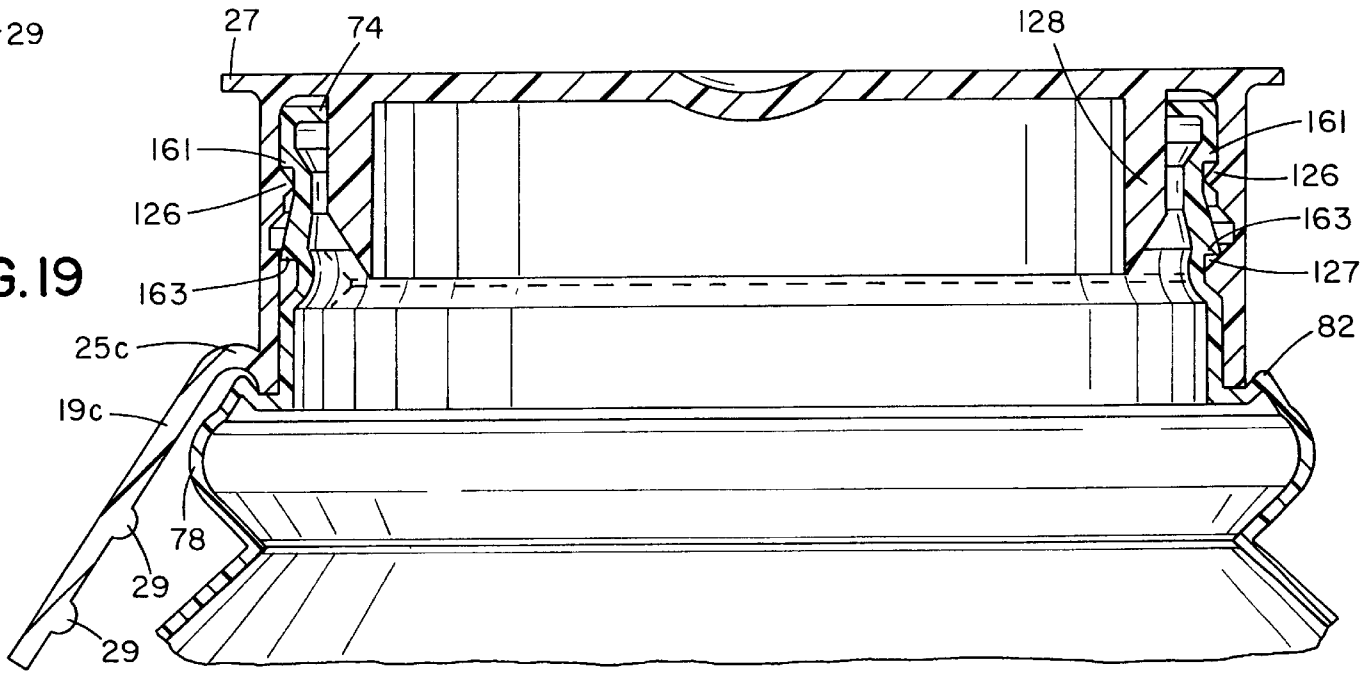

As can be seen in FIGS. 17 through 19, the cap 10*c* includes an integral plug element 128 which acts much like the plug 28 of the helically threaded cap described earlier. It will be recognized by those of ordinary skill in the art that either helically threaded caps or push-on caps may be made with or without an integral plug on the underside of the cover of such caps, and that a foil liner, of a type which may be bonded to a flange on the bottle neck by induction heating, may be used instead of an integral plug.

In FIG. 19, the cap 10*c* is shown assembled, i.e., pushed on, to a container neck 166 of a bottle neck 160. The bottle neck 160 includes non-helical external threads or beads, i.e., upper bead 161 and lower bead 163, which engage internal threads or beads, i.e., upper bead 126 and lower bead 127, on the inside surface of the cap 10*c*. As with the helically threaded embodiment described earlier, the cap 10*c* has a pull tab shaped to receive and accommodate a ridge 182 on a bumper roll 178. The curved upper part 25*c* of the pull tab 19*c* allow the pull tab 19*c* to project minimally in the outward direction from the bottle neck 166, while at the same time allowing the pull tab 19*c* to avoid stress and deformation which might prematurely bring the tearing action or separation of material along the thin-walled section 104.

The invention described herein as embodied in a container neck will have its most common application in the formation of containers made by a blow-molding method. Blow-molded containers are often used by bottlers of milk and juice because they are inexpensive and relatively simple to manufacture. Indeed, many bottlers have blow-molding machines at their bottling facilities to even further reduce costs; making the bottles on-site saves in transportation costs relating to the shipment of bulky empty containers.

Although the present invention has been described in considerable detail with reference to certain preferred embodiments, one skilled in the art will appreciate that the present invention can be practiced by other than the preferred embodiments, which have been presented for purposes of illustration and not of limitation. Therefore, the spirit and scope of the appended claims should not be limited to the description of the preferred embodiments contained herein.

What is claimed is:

1. A cap for a container, said cap, comprising a lid portion and an axially downwardly extending skirt, said skirt having an internal formation which engages a corresponding forming on an external portion of a container neck, said skirt having a breakable lower extension, a pull tab connected to said lower extension, said pull tab having a laterally extending part and an axially downwardly extending part, whereby said pull tab extends from said lower extension, and a lower edge of said lower extension is shaped to fit closely against an inwardly facing wall of a ridge formed on a shoulder of said container below said corresponding formation, said pull tab having a recess formed at an upper portion thereof for accomodating said ridge on said shoulder.

2. A cap in accordance with claim 1 wherein:

said pull tab is connected to a mid-height area of said lower extension and extends outwardly and downwardly from said cap.

3. A cap in accordance with claim 2 wherein:

said internal formation on said cap includes at least one thread, and said lower extension includes ramped ratchet teeth which prevent unscrewing of said cap after said cap is placed on said container unless said lower extension is at least partially broken away from said skirt.

4. A cap in accordance with claim 2 wherein:

said internal formation on said cap includes at least one bead which engages a corresponding bead on said neck, said beads being non-helical.

5. A cap in accordance with claim 1 wherein:

said pull tab is integrally formed with and extends from an area above said lower edge of said lower extension and extends laterally over said wall and downwardly past said wall to an elevation below said lower extension.

6. A cap and bottle neck including the combination of a tamper evident bottle cap and neck comprising an opening at an upper end of said neck, an annular axially extending neck surface surrounding said opening, said neck having at least one protrusion extending radially outwardly from said neck surface, said cap having a lid portion covering said opening and an annular skirt portion with at least one radially inwardly extending formation which engages said at least one protrusion on said neck, a lower tamper-indicating extension integrally connected to said skirt, said lower tamper-indicating extension being at least partially separable along a pre-determined location at any interface between said lower tamper indicating extension and said skirt, said neck having a shoulder with a ridge having a radially inwardly facing wall, a lower edge of said tamper-indicating extension disposed adjacent to said wall, said lower edge of said tamper-indicating extension being free of radial and axially downwardly extending portions, whereby said lower edge fits closely into an intersection between said wall and said shoulder, said bottle being a thin-walled blow-molded bottle, and said lower extension having a pull tab extending radially outwardly and downwardly from an outer surface of said skirt said pull tab having a space for accomodating said wall on said show.

7. A cap and bottle neck combination in accordance with claim 6 wherein:

said pull tab extends below said lower edge of said lower extension.

8. A cap and bottle neck combination in accordance with claim 7 wherein:

said pull tab is a flat member connected to a mid-height region of said lower extension, said lower edge of said extension being a continuous annular surface.

9. A cap and bottle neck combination in accordance with claim 8 wherein:

said at least one formation and said at least one protrusion each define a helical shape.

10. A cap and bottle neck combination in accordance with claim 8 wherein: said cap is a push-on cap and said at least one formation is a non-helical bead, and said at least one formation is a non-helical bead.

11. A cap, comprising a lid portion and an axially downwardly extending skirt, said skirt having an internal formation which engages a corresponding formation on an external portion of a container neck, said skirt having a breakable and removable lower extension, a pull tab connected to said lower extension, said pull tab having a laterally extending part and an axially downwardly extending part, whereby said pull tab extends outwardly and downwardly from said lower extension, and a lower edge of said lower extension is shaped to fit closely against an inwardly facing wall formed on a shoulder of said container below said corresponding formation, said pull tab being connected to said lower extension by a vertically disposed web, said web extending from a portion of a vertical edge of said pull tab to a vertical line of intersection between said web and said lower extension, said lower extension having a line of thinned cross-section extending from a lower edge of said lower extension to a upper edge of said extension, said line of intersection being radially aligned adjacent to said line of thinned cross-section.

* * * * *

UNITED STATES PATENT AND TRADEMARK OFFICE

CERTIFICATE OF CORRECTION

PATENT NO. : 6,523,710 B1
APPLICATION NO. : 09/467433
DATED : February 25, 2003
INVENTOR(S) : Walter E. Hidding, Douglas J. Hidding and Robert D. Hidding It is certified that error appears in the above-identified patent and that said Letters Patent is hereby corrected as shown below:

Column 11, line 19, “show” should be changed to --shoulder--.

Signed and Sealed this

Fourteenth Day of April, 2009

JOHN DOLL
*Acting Director of the United States Patent and Trademark Office*